US011094301B2

(12) United States Patent
Strickland

(10) Patent No.: US 11,094,301 B2
(45) Date of Patent: Aug. 17, 2021

(54) DRUM KEY

(71) Applicant: Mathew Strickland, Burlingame, CA (US)

(72) Inventor: Mathew Strickland, Burlingame, CA (US)

( * ) Notice: Subject to any disclaimer, the term of this patent is extended or adjusted under 35 U.S.C. 154(b) by 0 days.

(21) Appl. No.: 16/873,061

(22) Filed: Jan. 24, 2020

(65) Prior Publication Data

US 2020/0243054 A1 Jul. 30, 2020

Related U.S. Application Data

(60) Provisional application No. 62/918,338, filed on Jan. 26, 2019.

(51) Int. Cl.

| | |
|---|---|
| ***G10D 3/16*** | (2020.01) |
| ***G10D 13/16*** | (2020.01) |
| ***G10D 13/02*** | (2020.01) |

(52) U.S. Cl.

CPC ..... *G10D 13/16* (2020.02); *G10D 13/02* (2013.01)

(58) Field of Classification Search

CPC ..... G10D 13/16; G10D 13/02

See application file for complete search history.

(56) References Cited

U.S. PATENT DOCUMENTS

2017/0365241 A1* 12/2017 Jones ..... G10D 13/00

* cited by examiner

*Primary Examiner* — Kimberly R Lockett

(74) *Attorney, Agent, or Firm* — West & Associates, A PC; Stuart J. West

(57) ABSTRACT

A drum key is configured to turn a tension rod of a drum, where the tension rod is configured to tune the drum. The drum key comprises a first body having at least one recess shaped to receive the tension rod. The drum key comprises a second body configured to turn the drum key in response to receiving a force applied by a user. The drum key comprises a third body that defines a slot, where the slot is shaped to receive the tension rod. The drum key comprises a magnet located inside the slot defined by the third body and/or a magnet located inside the slot defined by the first, second, and third body.

15 Claims, 6 Drawing Sheets

DRUM KEY

CROSS-REFERENCE TO RELATED APPLICATIONS

This application claims priority to and the benefit of U.S. Provisional Application No. U.S. 62/918,338 filed Jan. 26, 2019, the entire disclosure of which is hereby incorporated by reference.

BACKGROUND

This disclosure relates to drum instruments used in music. More particularly, this disclosure relates to drum accessory hardware. Drum keys are used to turn drum tension rods that are configured to tune a drum. Previous drum keys include those described in U.S. Design Pat. No. D674,002, U.S. Design Pat. No. D346,100, U.S. Pat. Nos. 8,253,002, 7,244,882, and U.S. Design Pat. No. D404,986.

SUMMARY

Disclosed herein are drum keys that can be turned upside-down after use so that a flexible portion of the drum key can be placed on a tension rod configured to tune a drum. The flexible portion of the drum key in contact with the tension rod allows quiet storage of the drum key while a user plays the drum. The drum key has one or more flexible materials that enable quiet storage of the drum key on the tension rod and one or more rigid materials that enable the drum key to quickly turn the tension rod to quickly tune a drum, and/or to quickly turn a tension rod for replacing a drum head.

One aspect of this disclosure is a drum key configured to turn a tension rod of a drum, where the tension rod is configured to tune the drum. The drum key comprises a first body that defines at least one recess shaped to receive the tension rod. The drum key comprises a second body configured to turn the drum key in response to receiving a force applied by a user. The drum key comprises a third body that is flexible and defines a slot, where the slot is shaped to receive the tension rod. The drum key comprises a magnet located inside the slot defined by the flexible body.

In some implementations of the drum key, the first body is made of a first material and the second body is made of a second material, where the first material has a different density than the second material.

In some implementations of the drum key, the magnet has an exterior profile shaped to correspond to an interior profile of the slot defined by the third body.

In some implementations of the drum key, the magnet has an exterior profile shaped to correspond to an interior profile of the slot defined within the third, second and first body.

In some implementations of the drum key, the second body has a mass equal to or greater than a mass of the first body.

In some implementations of the drum key, the first body has a mass equal to or greater than a mass of the second body.

In some implementations of the drum key, the first body is attached to the second body and the second body extends in a direction perpendicular to the first body.

In some implementations of the drum key, a mass of the second body is concentrated in ends of the second body.

In some implementations of the drum key, the first body and the second body are made of a rigid material.

In some implementations of the drum key, at least a portion of the third body is made of a flexible material.

In some implementations of the drum key, the first body and the third body are attached to the second body, and the first body and the third body are located on opposite sides of the second body.

In another aspect of this disclosure, a method of storing the drum key comprises removing the first body from the tension rod, turning the drum key upside-down, and placing the third body on the tension rod such that the slot defined by the third body receives the tension rod.

In another aspect of this disclosure, a method of using the drum key to turn the tension rod comprises placing the first body on the tension rod such that the recess defined by the first body receives the tension rod. The method comprises applying a force to at least one end of the second body to turn the drum key, where the first body is attached to the second body and the second body extends in a direction perpendicular to the first body. A mass of the second body is concentrated in ends of the second body.

In another aspect of this disclosure, a drum key is configured to turn a tension rod of a drum, where the tension rod is configured to tune the drum. The drum key comprises a rigid horizontal body with a concentration of mass at ends of the horizontal body. The drum key comprises a rigid vertical body defining a slot shaped to receive the tension rod. The drum key comprises a flexible top defining a slot shaped to receive the tension rod for upside-down storage of the drum key on the tension rod. The drum key comprises a magnet shaped to fit inside the slot defined by flexible top and a rigid pin to permanently affix the above parts together.

These and other features, aspects and advantages of this disclosure will become better understood with reference to the following drawings and description.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
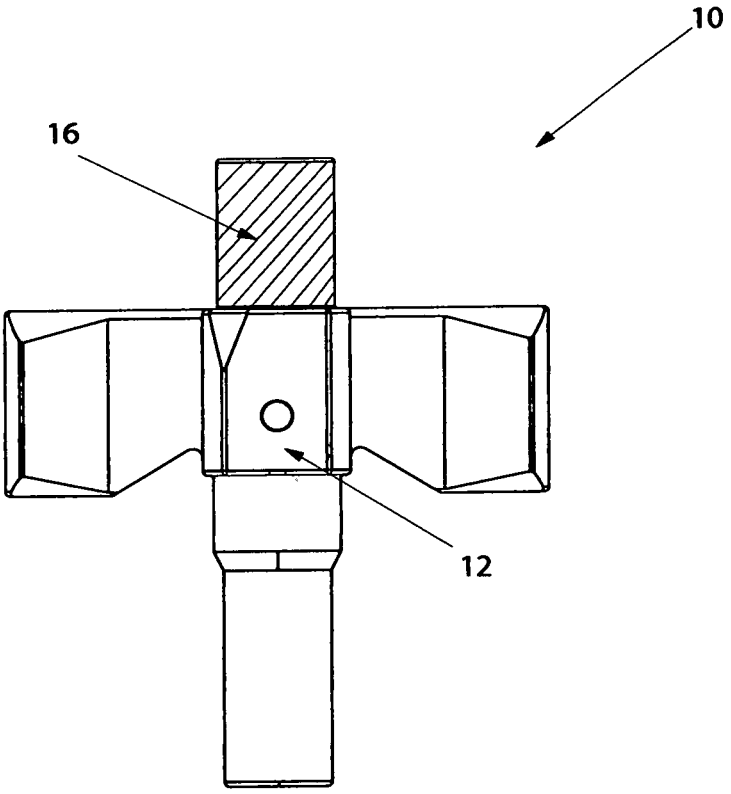
FIG. 1 is a front view of a drum key.

Disclosed herein are embodiments of a drum key that can be stored on a lug or a tension rod of a drum while preventing audible rattle between the drum key and tension rod while the drum is being played. FIG. 1 is a front view of a drum key according to one embodiment and is not intended to limit the scope of the disclosure. The drum key 10 includes a rigid body 12 and a flexible body 16. The flexible body 16 may also be referred to as a third body. At least a portion of the third body may include a flexible material. The rigid body 12 may include a first body and a second body. The first body may also be referred to as a rigid vertical body. The second body may also be referred to as a rigid horizontal body.

Figure 2:
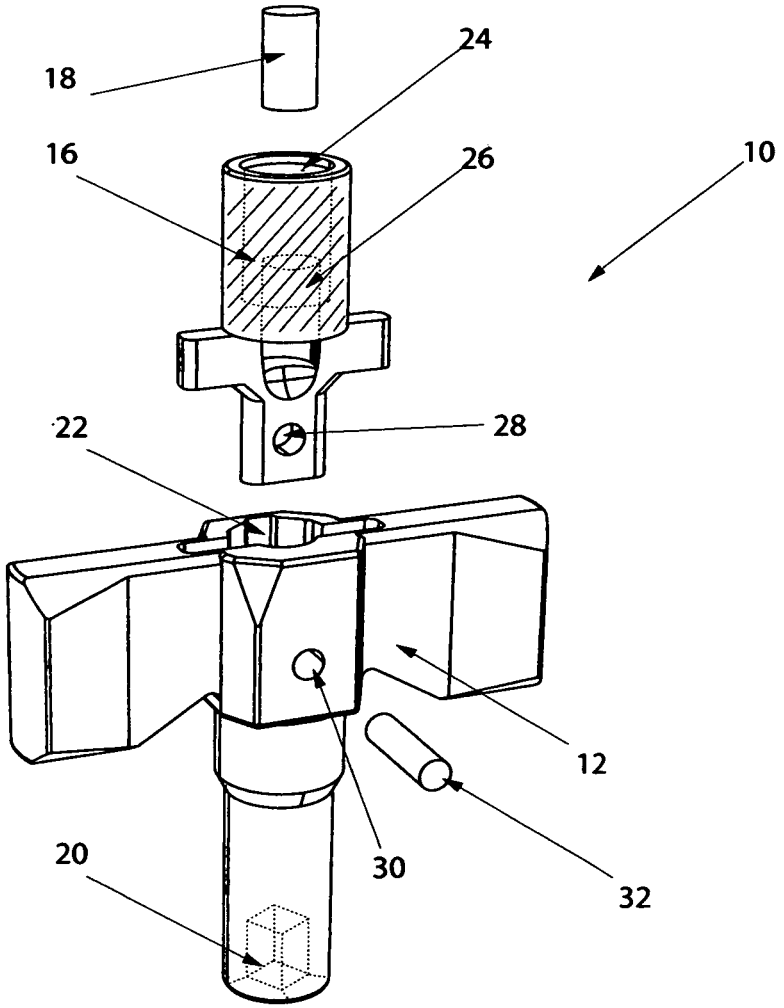
FIG. 2 is an exploded view of the drum key of FIG. 1.

FIG. 2 is an exploded view of the drum key 10. The drum key 10 defines a slot 20 shaped to receive a tension rod of a drum, where the tension rod is configured to tune the drum. The flexible body 16 defines a slot 24 shaped to receive the tension rod for quiet upside-down storage of the drum key 10 on the tension rod. The flexible body 16 defines a slot 26 shaped to receive a magnet 18. The magnet 18 is configured to apply a magnetic force to the tension rod to establish a secure connection between the drum key 10 and the tension rod during upside-down storage of the drum key 10 on the tension rod after tuning and during play. The flexible body 16 defines a hole 28 configured to receive a rigid dowel 32. The rigid body 12 defines a slot 22 configured to receive the flexible body 16. The rigid body 12 defines a hole 30 configured to receive a rigid pin 32 for assembly.

The rigid body 12 can be made of any metal, alloy, wood or any rigid material but may preferably be made of a heavy rigid material. The flexible body 16 can be made of any rubber, plastic, or any other flexible material but may preferably be made of a firmer flexible material.

Figure 3:
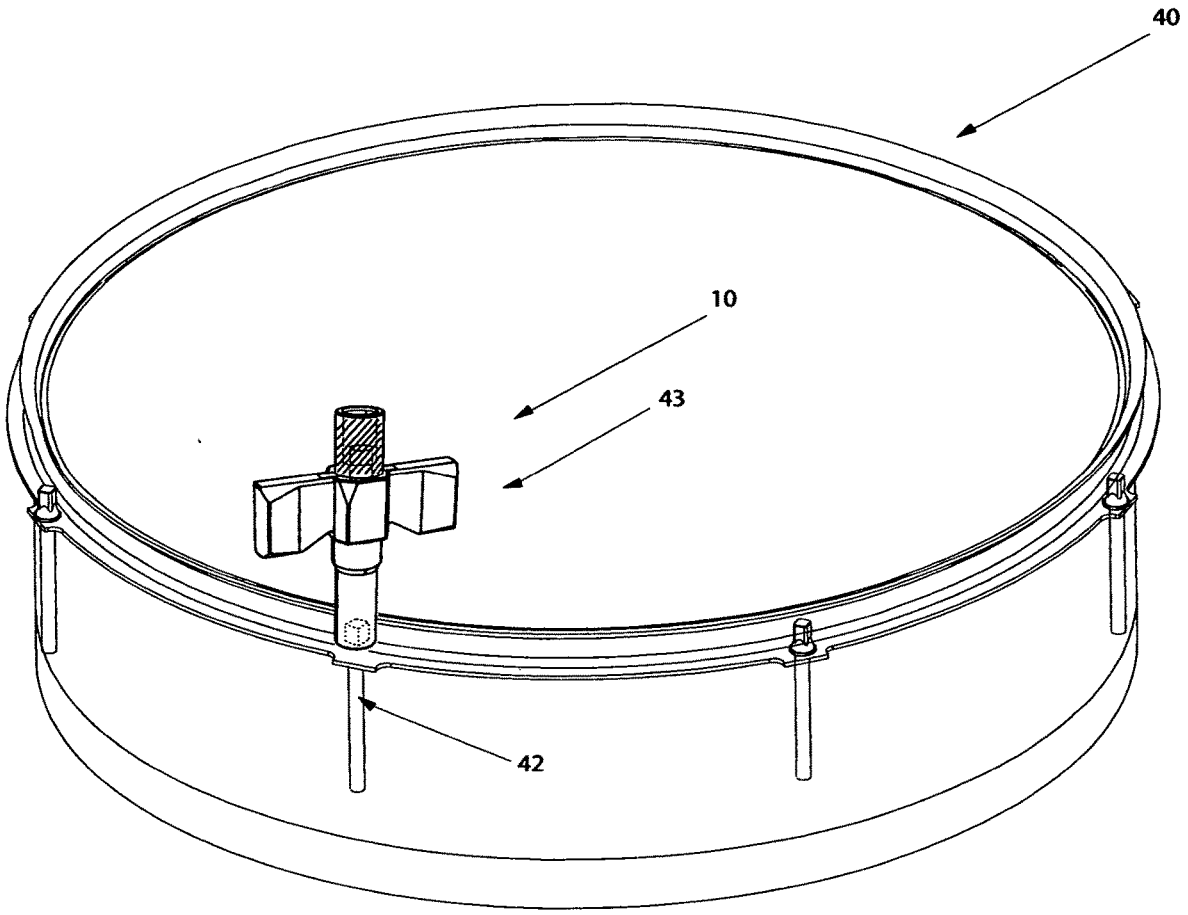
FIG. 3 is a perspective view of the drum key of FIG. 1 on a drum tension rod in a tuning position.

FIG. 3 is a perspective view of the drum key 10 on a drum 40 and a tension rod 42 in the tuning position 43.

Figure 4:
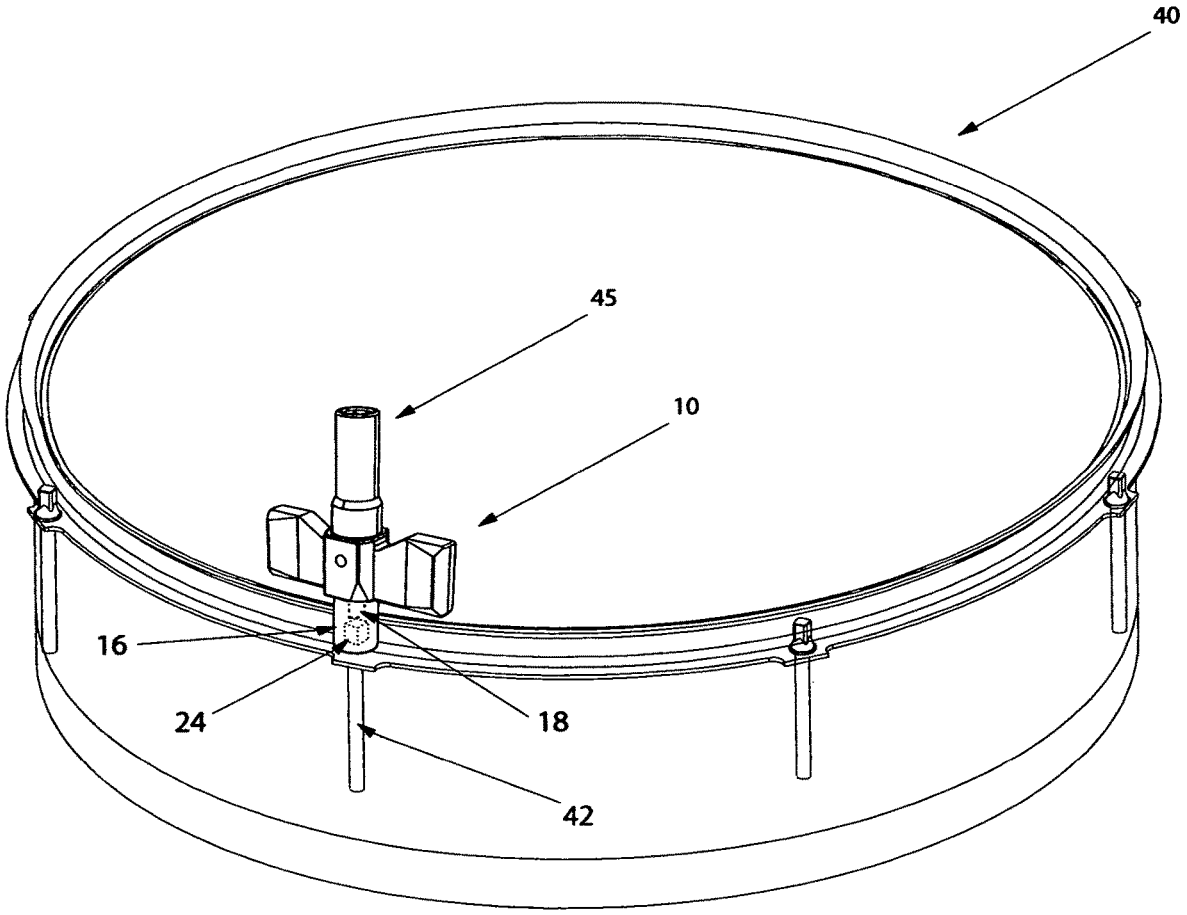
FIG. 4 is a perspective view of the drum key of FIG. 1 on the drum tension rod in an upside-down storing position.

FIG. 4 is a perspective view of the drum key 10 on a drum 40 and the tension rod 42 in the upside-down position 45 utilizing the flexible material 16 and the magnet 18 within the slot 24 for quiet storage of the drum key 10 on the tension rod 42.

Figure 5:
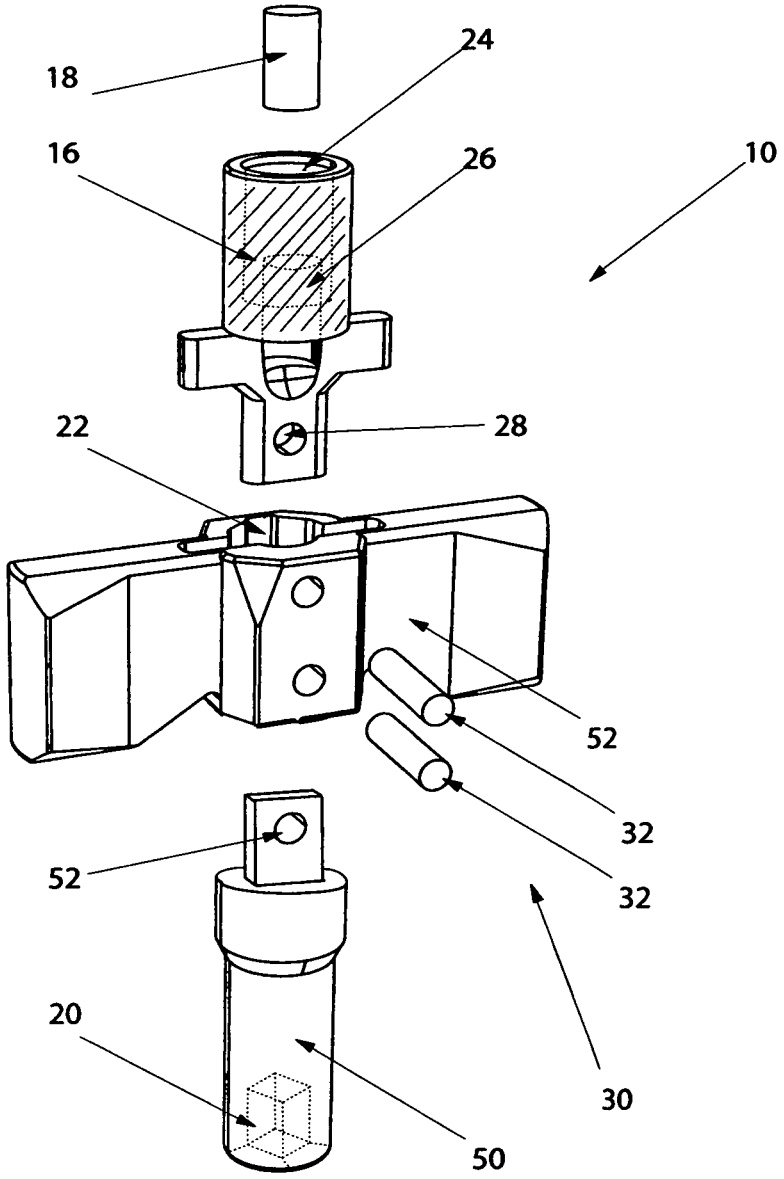
FIG. 5 is a perspective view of a drum key according to an alternate embodiment.

FIG. 5 is an alternate perspective view of the drum key 10 according to another embodiment where the rigid body 12 includes a vertical body 50 and a horizontal body 52. The vertical body 50 may be made of a first material and the horizontal body 52 may be made of a second material. The first material and the second material may have different densities. For example, the first material may have a greater density than the second material.

Figure 6:
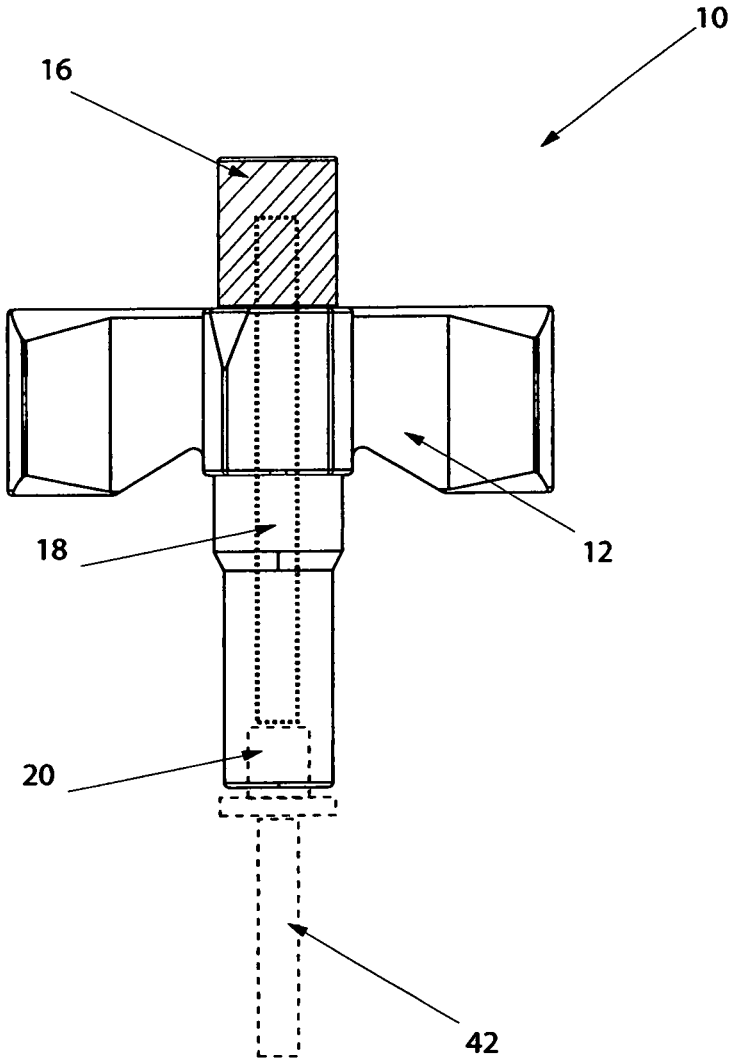
FIG. 6 is a perspective view of a drum key according to another alternate embodiment.

FIG. 6 is a perspective view of another alternate embodiment of the present invention 10 where the magnet 18 is longer and extends to the end of the second and first body to the opposite side where the magnet 18 will reach the open cavity 20 and will meet the tension rod 42.

Drummers, which may be referred to as users, need to tune their drum and be able to quickly locate a drum key to do so. After tuning, a drummer can put the key back in their pocket or store the drum key on the top of a bass drum, or in many cases, leave the drum key on the tension rod of a drum for later tuning. The problem with leaving the drum key on the drum is that when playing, the metal drum key resting on the metal drum tension rod will audibly rattle when the drum is played. Some drum keys incorporate a magnet within a slot of the drum key to help prevent the rattle of the drum key with the tension rods. However, such solutions are ineffective because metal-to-metal contact still creates audible rattle between the drum key and the tension rod. The audible rattle may become more pronounced due to loud, aggressive drumming. The drum keys disclosed herein prevent this audible rattle by incorporating a flexible body (e.g., a body made of a hard rubber) in a drum key, where the flexible body contacts the metal tension rod during storage of the drum key designed to keep a short distance from the imbedded magnet that could rattle. For convenience, the flexible body may be located on top of the drum key and may be sized to snuggly fit on the tension rod (e.g., over a lug of the tension rod). The flexible body may incorporate a magnets force to create a more secure connection to the tension rod and designed not to touch the tension rod to prevent metal to metal contact.

When the drummer needs to replace a drum head, many tension rods need to be loosened to get the drum head off of the drum which can be very time consuming and can lead to drummers keeping old drum heads on theirs drums for extended periods of time. The disclosed drum keys enable rapid unscrewing of the tension rods. The drum key may include a horizontal body, where the mass of the horizontal body is concentrated in the ends of the horizontal body. This configuration allows the drum key to quickly screw and/or unscrew the tension rod, allowing a drummer to quickly tune the drum and/or replace the drum head. While one end of the drum key is being used to turn the tension rod, the flexible material of the flexible body may also be gripped by the user to quickly spin the drum key between the thumb and first finger.

After taking off an old drum head, the drummer puts a new drum head over a shell of the drum. The drummer then places a drum hoop on top of the drum head. The drummer then inserts tension rods through rim slots and into threaded lug holes of the drum. The drummer then places the drum key over the tension rods to tighten. The horizontal body of the drum key is designed with more weight at the ends such that the drummer can rapidly spin the drum key like a top, for example by using the first finger and thumb to rotate the drum key quickly in a spinning motion. The drummer may also grip the flexible body to turn the drum key. Once all tension rods of a drum are semi-tight using this process, the drummer can use the horizontal body of the drum key to finely tighten each of the tension rods within a lug and tune the drum. After tuning of the drum is complete, the drummer can turn the key upside-down and attach the flexible body to the tension rod for storage. The flexible material of the flexible body prevents audible rattling from occurring during storage of the drum key, while the drum is played by the drummer. The distance of the magnet inside the flexible material is far enough away from the tension rod to prevent from rattling as well.

By using the disclosed drum keys, a drummer can keep his or her drum key handy during play without audible rattle occurring. Because, according to one example, the mass of the horizontal body of the drum key is concentrated in the ends of the horizontal body, the drum key can spin faster on the tension rod, resulting in quick removal and tuning of drum heads using only the disclosed drum keys, preventing the need for other tools. This effect occurs because of the weight distribution of the horizontal body relative to the vertical body.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A drum key configured to turn a tension rod of a drum, wherein the tension rod is configured to tune the drum, the drum key comprising:

a first body that defines at least one recess shaped to receive the tension rod;

a second body configured to turn the drum key in response to receiving a force applied by a user;

a third body that defines a slot, wherein the slot is shaped to receive the tension rod; and a magnet located inside the slot defined by the third body.

2. The drum key of claim 1, wherein the first body is made of a first material and the second body is made of a second material, wherein the first material has a different density than the second material.

3. The drum key of claim 1, wherein the magnet has an exterior profile shaped to correspond to an interior profile of the slot defined by the third body.

4. The drum key of claim 1, wherein the magnet has an exterior profile shaped to correspond to an interior profile slot in the third body that extends through an internal profile slot of the second and first body to reach the opening slot defined in the first body.

5. The drum key of claim 1, wherein the third body is shaped to prevent a magnet from touching any non-disclosed drum key surfaces.

6. The drum key of claim 1, wherein the first, second and third bodies are shaped to prevent a magnet from touching any non-disclosed drum key surfaces.

7. The drum key of claim 1, wherein the second body has a mass equal to or greater than a mass of the first body.

8. The drum key of claim 1, wherein the first body has a mass equal to or greater than a mass of the second body.

9. The drum key of claim 1, wherein the first body is attached to the second body and the second body extends in a direction perpendicular to the first body.

10. The drum key of claim 1, wherein a mass of the second body is concentrated in ends of the second body.

11. The drum key of claim 1, wherein the first body and the second body are made of a rigid material.

12. The drum key of claim 1, wherein at least a portion of the third body is made of a flexible material.

13. The drum key of claim 1, wherein the first body and the third body are attached to the second body, and wherein the first body and the third body are located on opposite sides of the second body.

14. A method of storing the drum key of claim 1, comprising:

removing the first body from the tension rod;

turning the drum key upside-down; and placing the third body on the tension rod such that the slot defined by the third body receives the tension rod.

15. A method of using the drum key of claim 1 to turn the tension rod, comprising:

placing the first body on the tension rod such that the recess defined by the first body receives the tension rod; and applying a force to at least one end of the second body to turn the drum key, wherein the first body is attached to the second body and the second body extends in a direction perpendicular to the first body, and wherein a mass of the second body is concentrated in ends of the second body.

* * * * *